United States Patent [19]

Rathgeber et al.

[11] Patent Number: 4,522,312

[45] Date of Patent: Jun. 11, 1985

[54] CONTAINER AND ASSOCIATED LATCH STRUCTURE

[75] Inventors: Juergen Rathgeber, Raleigh; William W. Ward, Clayton, both of N.C.

[73] Assignee: Southern Case, Inc., Raleigh, N.C.

[21] Appl. No.: 532,226

[22] Filed: Sep. 14, 1983

[51] Int. Cl.[3] ..... B65D 45/16

[52] U.S. Cl. ..... 220/324; 292/57; 292/249; 292/DIG. 38; 292/DIG. 53

[58] Field of Search ..... 220/324, 306, 334; 206/349; 292/246–250, 258, 87, 113, 57, DIG. 53, 249, DIG. 38

[56] References Cited

U.S. PATENT DOCUMENTS

| | | | |
|---|---|---|---|
| 633,269 | 9/1899 | Moore . | |
| 869,908 | 11/1907 | Johnson | 292/246 |
| 1,545,955 | 7/1925 | Goertz . | |
| 2,435,272 | 2/1948 | Graham | 220/343 |
| 3,490,805 | 1/1970 | Di Pierro et al. | 292/258 |
| 3,730,576 | 5/1973 | Schurman | 292/246 |
| 3,828,969 | 8/1974 | Schurman | 220/324 |
| 3,902,628 | 9/1975 | Schurman | 220/306 |
| 3,933,381 | 1/1976 | Schurman | 292/57 |
| 4,023,840 | 5/1977 | Souza et al. | 292/113 |
| 4,162,004 | 7/1979 | Thomas | 206/349 |
| 4,212,415 | 7/1980 | Neely | 220/324 |
| 4,244,612 | 1/1981 | Schurman | 292/249 |
| 4,270,668 | 6/1981 | Berfield | 220/324 |
| 4,388,991 | 6/1983 | Price | 220/324 |

*Primary Examiner*—George T. Hall

*Attorney, Agent, or Firm*—Bell, Seltzer, Park & Gibson

[57] ABSTRACT

A plastic container includes a hinge on one side thereof for hingedly joining the base and cover parts of the container. A latch structure is located on a container side opposite the hinge. The latch structure includes a buckle that is pivotally journaled in undercuts on the cover. The buckle is adapted to bridge the confronting edges and to pivot into and out of releaseable securement with the base.

12 Claims, 11 Drawing Figures

CONTAINER AND ASSOCIATED LATCH STRUCTURE

BACKGROUND OF THE INVENTION

1. Field of the Invention

The invention relates generally to containers. More particularly, the invention relates to latch structures for securing the cover and base of containers in a closed position.

2. Description of the Prior Art

Plastic containers having base and cover parts that are hinged together along one side for movement between open and closed positions are well known. Such containers usually contain a latch structure at the side opposite the hinge.

U.S. Pat. Nos. 3,730,576 and 4,244,612 illustrate blow molded containers of the mentioned type wherein the latch structure is formed by a one-piece plastic buckle that snap fits onto one of the container parts and includes a resilient catch for releaseably engaging the other container part. While these patented latch structures have gained acceptance in the industry, they have certain drawbacks, including ease of accidental or intentional removal of the buckle, material fatigue with repeated use, and interference of the buckle in the closing of the container.

SUMMARY OF THE INVENTION

The present invention provides a container having a latch structure that avoids the various disadvantages heretofore characterizing prior container products. More particularly, in accordance with the present invention, while the latch buckle may be simply and readily attached in the manufacturing operation, the design makes difficult the accidental or even intentional removal of the buckle by the end user.

Normal use of the latch of the invention does not involve a force component that will tend to separate the latch buckle from the container. Furthermore, normal use does not necessitate repeated deformation of the buckle or other latch components, thereby eliminating material fatigue with repeated use.

Another advantage of the present invention is that when the container is in an open position the novel latch structure permits the latch buckle to remain in a fixed position away from the confronting edges of the container parts so that it does not interfere with the subsequent closing of the container. In particular embodiments, the latch buckle may be pivoted to a position where it is held at 90° or 180° from its position of securement.

In addition to the foregoing advantages, the present invention provides a latch structure that may be incorporated into the valance of a container without substantially interrupting the continuity of the valance.

Broadly, the present invention provides a container of the mentioned type incorporating a latch assembly that has a buckle comprised of opposed attachment and latching portions and a body portion joining the attachment and latching portions. The attachment portion includes rod means defining a central rod segment and a pair of outwardly extending rod segments. Rod receiving undercuts are formed on one of the container parts adjacent and parallel to the confronting edge of that part. The undercuts form a journal for pivoting of the buckle so that it may bridge the confronting edges of the container and be releaseably secured by the latching portion to the other part.

In certain embodiments the latch structure is incorporated into the valance of the container in an aesthetically pleasing manner. In these embodiments a latch recess is formed in the valance for accommodating the latch buckle.

BRIEF DESCRIPTION OF THE DRAWINGS

The invention will be more fully understood from the following detailed description thereof taken on connection with the accompanying drawings, in which.

DETAILED DESCRIPTION OF THE INVENTION

While the present invention will be described more fully hereinafter with reference to the accompanying drawings, in which a preferred embodiment of the present invention is shown, it is to be understood at the outset of the description which follows that persons of skill in the appropriate arts may modify the invention here described while still achieving the favorable results of this invention. Accordingly, the description which follows is to be understood as being a broad, teaching disclosure directed to persons of skill in the appropriate arts, and not as limiting upon the present invention.

Figure 1:
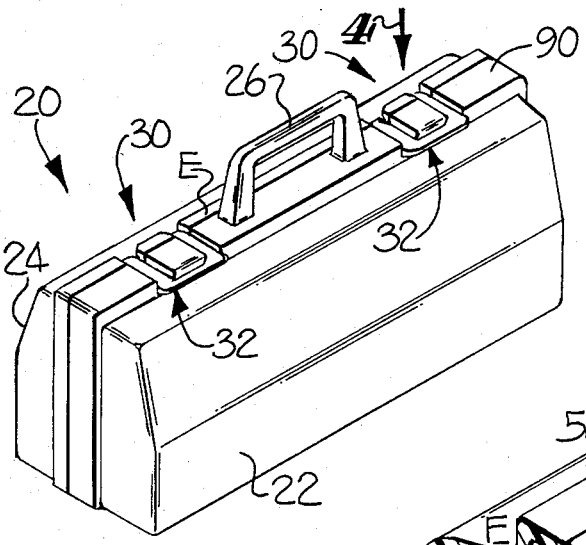
FIG. 1 is a perspective view of a double-wall blow molded container incorporating two latch structures of the invention.
Figure 1A:
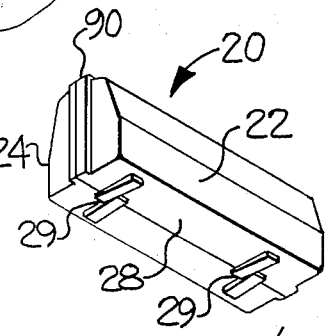
FIG. 1A is a bottom perspective view, on a reduced scale, of the container illustrated in FIG. 1.
Figure 4:
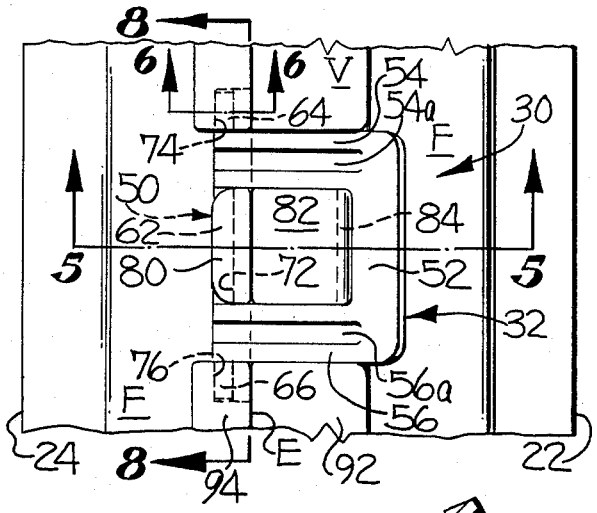
FIG. 4 is a top view of one of the latch structures as seen along the arrow 4 of FIG. 1.

Referring to the drawings, and particularly to FIG. 1, there is shown a double-wall blow molded plastic container 20 having a base 22, a cover 24 and a handle 26. The base and cover are hingedly joined along the bottom 28 of the container by a hinge assembly 29 (FIG. 1A). Container 20 is movable between the closed position illustrated in FIG. 1 and various open positions.

The container is held in the closed position by securement of a pair of identical latch structures 30 that bridge the abutting confronting edges E of the base and cover members. Each latch structure includes a buckle 32 that is pivotally attached to the cover in a journal adjacent the confronting edge of the cover. Buckle 32 is also adapted for releaseable securement to the base in a manner described in detail below.

Figure 3:
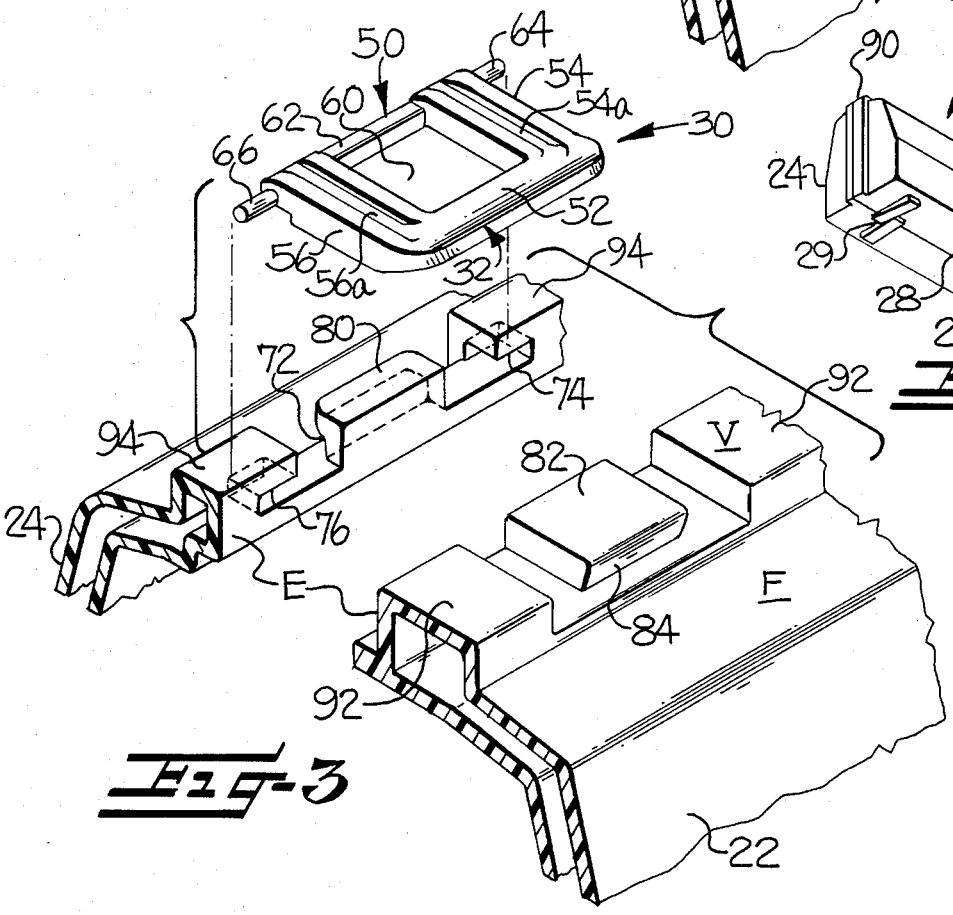
FIG. 3 is an exploded view of the parts illustrated in FIG. 2.
Figure 9:
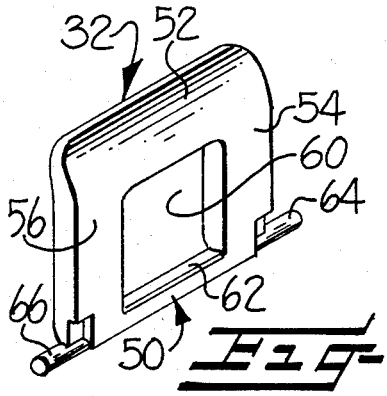
FIG. 9 is a perspective view of the rear face of the latch buckle.

Buckle 32 preferably is formed of a one-piece plastic construction in a generally rectangular configuration, as best shown in FIGS. 3 and 9. Buckle 32 includes spaced apart, substantially parallel attachment and latching portions 50, 52, respectively, and a body portion defined by substantially parallel sides 54, 56 joining the attachment and latching portions. Recesses 54*a* and 56*a* are formed in the sides for aesthetic purposes and to reduce the amount of material in the buckle. The attachment and latching portions and sides define a central rectangular opening 60 in the body of the buckle. The attachment portion 50 includes rod means defining a central rectangular rod segment 62 and a pair of end rod segments 64, 66 that extend out beyond buckle sides 54, 56.

Figure 6:
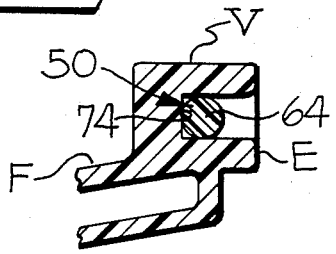

The journal for receiving the rod segments 62, 64, 66 is formed by aligned undercuts formed adjacent the confronting edge of the cover. A central undercut 72 for receiving central rod segment 62 is formed on a buckle attachment boss 80 that is molded integrally adjacent the confronting edge of the cover. Undercuts 74, 76, one being shown in detail in FIG. 6, are formed in the face of the confronting edge of the cover for receiving respective ones of the end rod segments 64, 66. In the illustrated embodiment, rod segments 62, 64, 66 are colinear; therefore, the undercuts 72, 74, 76 forming the journal are axially aligned to receive the rod segments. It will be appreciated, however, that the rod segments may be formed in other than an aligned configuration in which case the undercuts forming the journal likewise would be non-aligned.

Figure 2:
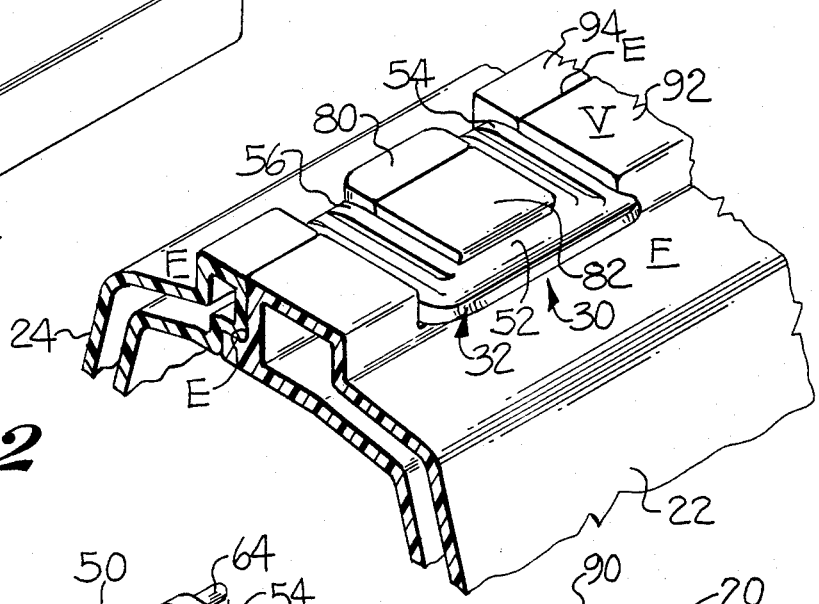
FIG. 2 is an enlarged, fragmentary view of one latch assembly and adjacent portions of the container.
Figure 5:
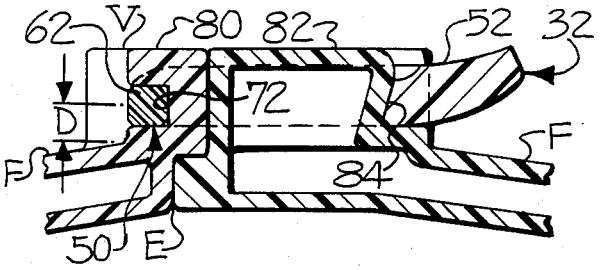
FIGS. 5 and 6 are sectional views taken substantially along lines 5—5 and 6—6, respectively, of FIG. 4.

A latching boss 82 is formed adjacent the confronting edge of base 22 for facilitating the releasable engagement of buckle 32 when the buckle bridges the confronting edges. Boss 82 includes a negative relief 84 at its surface remote from the confronting edge of the base for releasably engaging the latching portion 52 of the buckle. When so latched, the bosses 80, 82 lie within and project through buckle central opening 60 (FIG. 2). It will be noted that buckle latching portion 52 preferably is turned up somewhat out of the plane of the remainder of the buckle (FIG. 5) in order to aid in finger engagement thereof during unlatching operations.

While the invention is not so limited, in the illustrated embodiment and other embodiments container 20 is formed with a continuous integrally molded valance 90 that extends around substantially the entire container adjacent the confronting edges. Valance 90 lends an aesthetically pleasing appearance to the container and also provides an improved dust seal along the confronting edges of the base and cover.

Valance 90 is formed by cooperative protruding portions 92, 94 on the base and cover parts, respectively. Portions 92, 94 extend out from the side faces F of the container and define a continuous raised valance face V.

It will be appreciated that latch structure 32 fits within the valance in an aesthically pleasing manner. To this end, the latch structure is located in a latch recess formed in the valance with the latch recess having a width sufficient to accommodate the body of the latch buckle therein. Preferably the attachment and latching bosses 80, 82 are formed in the latch recess so as to appear to be essentially continuations of the valance surface V while performing their above-described functions. Most preferably the bosses have substantially the same relief as the valance. Further, by locating the journal for the buckle rod means at a position outwardly disposed from the adjacent face F of the cover (dimension D, FIG. 5), the buckle may be made to conveniently reside in the latch recess in the illustrated manner.

The assembly of buckle 32 into its journal is done in a quick, simple operation by first inserting one of the end rod segments 64 or 66 in its undercut, then pivoting the buckle so that the central rod segment moves into its undercut and finally deforming the buckle slightly so that the other end rod segment fits into its undercut. While the assembly operation is simple, a significant advantage of the invention is that it is quite difficult for an untrained end user of the product to accidentally, or even intentionally, remove the buckle. Further, it will be appreciated that in years of repetitive use the latch parts are not deformed and, therefore, are not subject to material fatigue.

Figure 7:
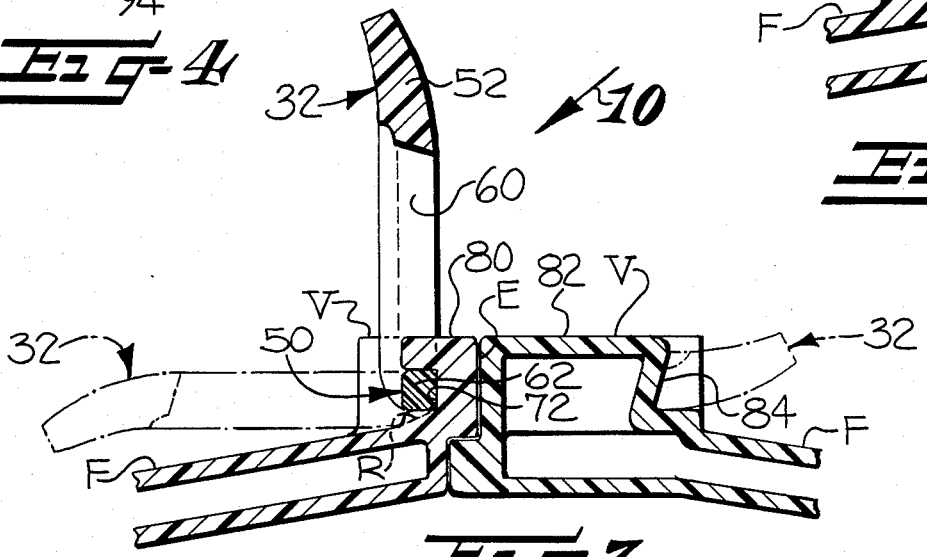
FIG. 7 is a sectional view, similar to FIG. 5, showing the latch buckle in three positions.
Figure 8:
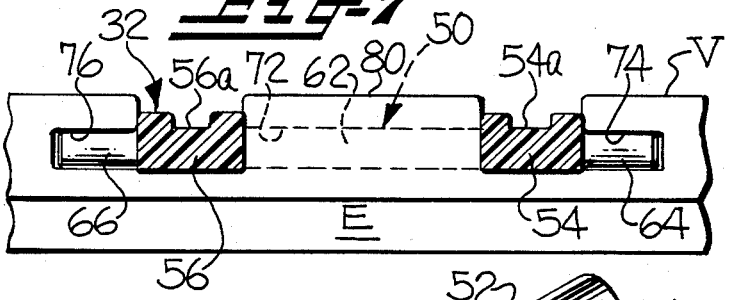
FIG. 8 is a sectional view taken substantially along line 8—8 of FIG. 4.
Figure 10:
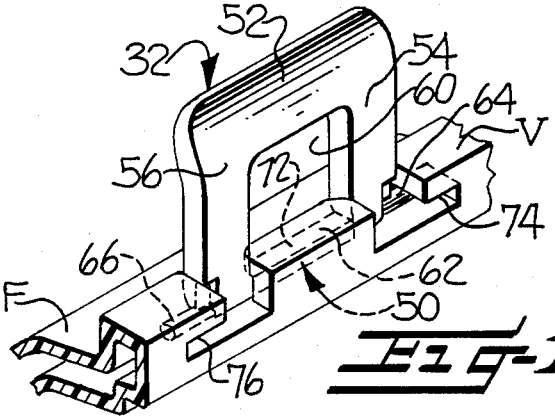
FIG. 10 is a perspective view of the latch buckle as oriented in FIG. 9, but shown journaled in the undercuts as viewed along the line 10 of FIG. 7.

Another feature of the instant invention is that the buckle central rod segment 62 is formed with a cross section that cooperates with its respective undercut 72 so as to facilitate location of the buckle at angular orientations where the buckle will not interfere with the closing of the case prior to latching. To this end, central segment 62 is formed with a square cross section that cooperates with a mating square cross section of its cooperative recess 72. Thus, latch buckle 32 tends to naturally locate in the three postions illustrated in FIG. 7 wherein the cross sections of the rod segment 62 and undercut 72 conform. The cross sections are designed to conform when the buckle is in the latch securement position (FIG. 5 and dashed lines to the right of FIG. 7) and when the buckle is rotated to a 90° position (FIG. 10 and solid lines, FIG. 7) and a 180° position (dashed lines to the left of FIG. 7).

Due to the configuration of buckle 32, the face F of the cover side adjacent the buckle is provided with a relief R (FIG. 7) to permit the pivoting of the buckle through 180°. It will be appreciated that at all intermediate positions between the three positions illustrated in FIG. 7 the cross sectional configurations of rod segment 62 and undercut 72 will produce a frictional engagement or interference and that this interference will be relieved in the three illustrated positions. It has been found that the interference produces a desirable resistance to motion as the buckle moves through the 180 degrees of pivotal movement.

While the present invention has been described in connection with preferred embodiments it will be appreciated that modification may be made without departing from the true spirit and scope of the invention.

What is claimed is:

1. In a container having base and cover parts that are movable between open and closed positions and define respective confronting edges that abut each other when the container is in the closed position, a latch assembly comprising:

a buckle comprising spaced apart attachment and latching portions and a body portion joining the attachment and latching portions, said attachment portion including rod means defining a central rod segment and a pair of outwardly extending end rod segments;

rod receiving undercuts formed on one of said container parts adjacent the confronting edge thereof, said undercuts including a central undercut for receiving said buckle central rod segment and a pair of end undercuts for receiving respective ones of said buckle end rod segments, said undercuts forming a journal for pivoting of the buckle to a latch securement position where the buckle body portion bridges the abutting confronting edges; and cooperative means on the latching portion of the buckle and the other container part for releaseably securing the buckle to the other part when the buckle is in the mentioned latch securement position.

2. A container as set forth in claim 1 wherein the buckle rod segments are colinear and said central and end undercuts are generally parallel to the confronting edge of the container part on which they are formed and are axially aligned.

3. A container as set forth in claim 2 wherein the central undercut faces in a direction perpendicular to the adjacent confronting edge and the end undercuts face in a direction generally opposite that of the central undercut.

4. In a container having base and cover parts that are movable between open and closed positions and define respective confronting edges that abut each other when the container is in the closed position, a latch assembly comprising:

a one-piece generally rectangular buckle comprising spaced apart, substantially parallel attachment and latching portions and substantially parallel sides joining the attachment and latching portions, said attachment portion including rod means defining a central rod segment and a pair of outwardly extending end rod segments;

rod receiving undercuts formed on one of said container parts adjacent and parallel to the confronting edge thereof, said undercuts including a central undercut for receiving said buckle central rod segment and a pair of end undercuts for receiving respective ones of said buckle end rod segments, said central and end undercuts being substantially aligned and facing in substantially opposite directions so as to form a journal for pivoting of the buckle to a latch securement position where the buckle sides bridge the abutting confronting edges; and cooperative means on the latching portion of the buckle and the other container part for releaseably securing the buckle to the other part when the buckle is in the mentioned latch securement position.

5. A multisided container comprising:

base and cover parts;

a hinge structure on one side of said container for hingedly joining together said parts so that the parts are movable between open positions and a closed position;

said container parts in said closed position defining respective abutting confronting edges;

the container side opposite said hinge structure including a valance formed by cooperative protuding portions on both the base and cover parts adjacent the confronting edges of said parts, said protruding portions extending out from the side faces of the container and defining a raised valance face;

a latch structure comprising:

a buckle comprising spaced apart attachment and latching portions and a body portion joining the attachment and latching portions, said attachment portion including rod means defining a central rod segment and a pair of outwardly extending end rod segments;

a latch recess formed in said valance and having a width sufficient to accommodate the body portion of the latch buckle therein;

a journal located adjacent the confronting edge of one container part at said latch recess for pivotally receiving said buckle rod segments, said journal including a central undercut located in said latch recess for receiving said buckle central rod segment and said journal further including a pair of end undercuts formed in the valance portions adjacent each side of said latch recess for receiving respective ones of said buckle end rod segments; and cooperative means on the latching portion of the buckle and the other container part for releaseably engaging the buckle to the other part.

6. A container as set forth in claim 5 wherein said central and end undercuts are substantially aligned and face in substantially opposite directions.

7. A container as set forth in claim 6 wherein said central undercut faces away from the confronting edges and said end undercuts face toward the confronting 8. A multisided container comprising:

base and cover parts;

a hinge structure on one side of said container for hingedly joining together said parts so that the parts are movable between open positions and a closed position;

said container parts in said closed position defining respective abutting confronting edges;

a valance extending around the container adjacent the confronting edges, said valance being formed by cooperative protruding portions on both the base and cover parts that extend out from the side faces of the container and define a continuous raised valance face;

a latch structure comprising:

a one-piece rectangular buckle comprising spaced apart, substantially parallel attachment and latching portions and a body defined by substantially parallel sides joining the attachment and latching portions, said portions and sides defining a central rectangular opening in said buckle, said attachment portion including rod means defining a central rod segment that extends between said sides an a pair of end rod segments that extend out beyond the sides;

a latch recess in said valance on a side of the container opposite the hinge assembly, said latch recess having a width sufficient to accommodate the body of the latch buckle therein;

a journal located adjacent the confronting edge of one container part at said latch recess for pivotally receiving said buckle rod segments, said journal including an attachment boss located in said latch recess and defining an undercut for receiving said buckle central rod segment and said journal further including a pair of end undercuts for receiving respective ones of said buckle end rod segments, said end undercuts being formed in the valance adjacent said latch recess, and said central and end undercuts being axially aligned at a position outwardly disposed from the adjacent face of the container side; and cooperative means on the latching portion of the buckle and the other container part for releaseably securing the buckle to the other part.

9. A container as set forth in claim 8 wherein said cooperative means comprises a latching boss formed adjacent the confronting edge of the other container part at said latch recess, said latching boss including a negative relief at its surface remote from the confronting edge for releaseably engaging the buckle latching portion in such a manner that the attachment and latching bosses project through the buckle central opening.

10. A container as set forth in claim 9 wherein the attachment and latching bosses have substantially the same relief as the valance.

11. A container as set forth in claim 8 wherein at least one of said buckle rod segments is formed with a cross-section that cooperates with its respective undercut so as to facilitate location of the buckle at an angular orientation that will not interfere with closing of the container.

12. A container as set forth in claim 11 wherein said cross-section is substantially square.

* * * * *